US005595956A

United States Patent [19]

Slark et al.

[11] Patent Number: 5,595,956

[45] Date of Patent: Jan. 21, 1997

[54] THERMAL TRANSFER PRINTING DYE SHEET

[76] Inventors: Andrew T. Slark, 48 Dryden Road, Ipswich, Suffolk, IP1 6QP; David W. Jarvis, 74 Wickham Road, Colchester, Essex, CO3 3EE, both of England; Akihiro Kawamura, 1-15-1 Hanabatake, Tsukuba-city, Ibaraki-ken 305, Japan

[21] Appl. No.: 387,825

[22] PCT Filed: Aug. 26, 1993

[86] PCT No.: PCT/GB93/01820

§ 371 Date: May 3, 1995

§ 102(e) Date: May 3, 1995

[87] PCT Pub. No.: WO94/04373

PCT Pub. Date: Mar. 3, 1994

[30] Foreign Application Priority Data

Aug. 26, 1992 [GB] United Kingdom ..... 9218183

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 428/500, 913, 914; 503/227

[56] References Cited

U.S. PATENT DOCUMENTS 4,946,826 8/1990 Kubo et al. ..... 503/227

FOREIGN PATENT DOCUMENTS 0141678 5/1985 European Pat. Off. ..... 503/227
0469723 2/1992 European Pat. Off. ..... 503/227

OTHER PUBLICATIONS

Database WPI Week 8903 Derwent Publications Ltd., London, GB; AN 89–019534 & JP A 63 295292 (Matsushita Elec. Ind. KK) See Abstract.

*Primary Examiner*—Bruce H. Hess
*Attorney, Agent, or Firm*—John M. Sheehan

[57] ABSTRACT

TTP dye sheets having a dye coat comprising a binder which comprises a mixture of a polyvinyl butyral polymer and a second polymer, at least 10% of the monomeric units of the second polymer being derived from parahydroxystyrene, the phenyl group of which may or may not be further substituted, are disclosed.

9 Claims, No Drawings

THERMAL TRANSFER PRINTING DYE SHEET

This invention relates to a thermal transfer printing (TTP) dye sheet, in particular to a dye sheet having an improved dye binder.

Thermal transfer printing is a printing process in which a dye is caused, by thermal stimuli, to transfer from a dye sheet to a receiver sheet thereby to form an image on the receiver sheet. In such a process, the dye sheet and receiver sheet are placed in intimate contact, the thermal stimuli are applied to the dye sheet to cause dye transfer and the dye sheet and receiver sheet are then separated. By applying the thermal stimuli to pre-determined areas in the dye sheet, the dye is selectively transferred to the receiver to form the desired image. The thermal stimuli my be provided by a programmable print head which is in contact with the dye sheet or by for example, a laser in a light-induced thermal transfer process (LITT).

Dye-sheets conventionally comprise a substrate having on one surface thereof a dye coat which typically comprises a thermally transferable dye dispersed or dissolved in a binder. Dye-sheets may also comprise a back coat to impart desirable properties for example, good handling and thermal characteristics to the dye sheet. Further, a primer or subbing layer my be employed between the substrate and the dye coat and/or the substrate and the back coat for example to improve the adhesion of the coat to the substrate.

Many materials have been suggested for use as the binder including, polyvinylbutyral as disclosed in EP-A-141678, cellulosic polymers as disclosed in J03264393, epoxy resins and phenolic resins.

During the TTP process, application of a thermal stimulus to an area of the dye coat on the the dye sheet heats that area of the sheet to a temperature typically in excess of 100° C. as a result of which the dye in that area of the dye sheet is transferred to the receiver sheet. On removal of the thermal stimulus the temperature of the heated area then decreases to the ambient operating temperature in the process.

However, once the thermal stimulus is removed and the temperature of the heated area of the dye sheet is decreasing, there may still be sufficient heat to cause unwanted, uncontrolled residual transfer of dye to the receiver sheet which may cause a reduction in image quality. This problem is referred to herein as low temperature thermal transfer.

We have now found that by employing a dye sheet binder having a particular mixture of polymer components, problems due to low temperature thermal transfer may be reduced or avoided and other significant advantages may also be secured.

Accordingly, a first aspect of the invention provides a thermal transfer printing dye sheet which comprises a substrate having on one side, a dye coat comprising a binder and a thermally transferable dye wherein the binder comprises a mixture of a polyvinyl butyral polymer and a second polymer having, as at least 10% of the monomeric units of the polymer, a monomeric unit of formula (I);

$$—[H_2C—CXY]— \quad (I)$$

wherein X is H or methyl and Y is an optionally substituted phenyl group, a cyano group or an ester group of formula $—CO_2Z$ wherein Z is an optionally substituted $C_1$ to $C_6$ hydrocarbyl group with the proviso that where Y is an unsubstituted phenyl group the second polymer also has a substituted styrene and/or a non-styrene monomeric unit.

Dye-sheets according to the present invention have been found to exhibit a particularly advantageous combination of characteristics. In particular, good resistance to low temperature thermal transfer may be achieved which provides for improved image quality and images may be produced which have excellent optical density.

Also, we have found that when the dye sheet is to be used to produce multi-colour images by using a dye sheet comprising a plurality of panels of different uniform colours, usually magenta, yellow and cyan, improved colour balance between the dyes by matching the three colours may be achieved. A practical benefit of this is that an excess of one or more of the colours leading to a colour imbalance and hence a tinge of the image may be reduced or avoided, such imbalance being particularly undesirable and visually prominent in neutral colours for example grey.

The second polymer may be a homopolymer, the monomeric unit of which is derived from parahydroxystyrene, the phenyl group of which may or may not be further substituted.

Alternatively, the second polymer may be a copolymer (block, random, alternating or graft) and formed of monomeric units according to formula 1 where Y is substituted phenyl and monomeric units according to formula 1 where Y is unsubstituted phenyl or an ester group of formula $—CO_2Z$ where Z is an optionally substituted $C_1$ to $C_6$ hydrocarbyl group, and/or monomeric units derived from maleic anhydride.

According to a further alternative, the second polymer may be a copolymer formed of monomeric units according to formula 1 where Y is unsubstituted phenyl and monomeric units derived from maleic anhydride.

In another alternative, the second polymer may be a copolymer formed of monomeric units according to formula 1 where Y is unsubstituted phenyl and monomeric units according to formula 1 where Y is an ester group of formula $—CO_2Z$ where Z is an optionally substituted $C_1$ to $C_6$ hydocarbyl group.

Preferably, the further substituent on the phenyl group is halogen (most preferably bromine), glycidyl neodecanoate, hydroxymethyl, dimethylaminomethyl, 2-hydroxyethylmethylaminomethyl, t-butyl, sulphonate, styrene or benzoate.

According to a further preferred feature, the hydocarbyl group is hydroxyethyl, hydroxypropylor hydroxybutyl.

A most preferred thermal transfer printing dye sheet comprises a substrate having on one side, a dye coat comprising a binder and a thermally transferable dye wherein the binder comprises a mixture of a polyvinyl butyral polymer and a second polymer selected from the group consisting of:

a parahydroxystyrene homopolymer, a bromo-parahydroxystyrene homopolymer, a coplymer of parahydroxystyrene and parahydroxystyrene further substituted with halogen (eg bromine), glycidylneodecanoate, hydroxymethyl, dimethylaminomethyl, 2-hydroxyethylmethylaminomethyl, t-butyl, sulphonate, styrene or benzoate, a coplymer of parahydroxystyrene with or without a further substituent on the phenyl group and any one or a mixture of methyl (meth)acrylate, 2-hydroxy(meth)acrylate, butyl (meth)acrylate, fluoro(meth)acrylate and acrylic acid.

Where the second polymer is a copolymer, suitably at least 10% and preferably at least 25% of the monomeric units of the polymer, based on the total number of monomeric units in the polymer, are of formula (I). The two monomeric units are suitably present in a ratio in the range 15:85 to 85:15 and preferably 25:75 to 75:25.

The glass transition temperature (Tg) of the second polymer is suitably in the range 50° to 200° C. and preferably 60° to 185° C.

A further aspect of the invention provides a thermal transfer printing method which comprises placing a dye-sheet according to any aspect of the present invention in contact with a receiver sheet which comprises a substrate having on one side a dye-receptive surface, applying thermal stimuli to the dye-sheet at pre-determined locations to effect thermal transfer of the dye from the said locations to the dye-receptive surface thereby to form a pre-determined dye image and separating the dye-sheet and receiver sheet.

Suitably, the polyvinyl butyral (PVB) polymer has a molecular weight of 30000 to 250000, for example 100000 and has a Tg in the range 20° to 200° C., preferably 50° to 185° C. for example 85° C.

Both the polyvinyl butyral polymer and the second polymer are suitably present in the dye sheet binder composition in an amount of at least 5% by weight of the total binder. Preferably the binder comprises the polyvinyl butyral polymer and the second polymer in a weight ratio of 95:5 to 5:95 and more preferably in a ratio of 85:15 to 15:85.

The dyecoat is formed by coating the substrate with an ink prepared by dissolving or dispersing one or more thermal transfer dyes and the binder in a liquid vehicle to form a coating composition; then removing any volatile liquids. Any dye capable of being thermally transferred in the manner described above, may be selected as required. Dyes known to thermally transfer, come from a variety of dye classes, e.g. from such nonionic dyes as azo dyes, anthraquinone dyes, azomethine dyes, methine dyes, indoaniline dyes, naphthoquinone dyes, quinophthalone dyes and nitro dyes.

The ink may also include dispersing agents, antistatic agents, antifoaming agents, and oxidation inhibitors, and can be coated onto the substrate as described for the formation of the latter. The thickness of the dyecoat is suitably 0.1–5 μm, preferably 0.5–3 μm.

The dye and binder are suitably present in a weight ratio of 0.3 to 3:1 of dye to binder. The relative amount of dye and binder is suitably selected according to the particular dye and binder employed and also the application for which the dye sheet is intended to be used.

Preferably, the dye sheet comprises a backcoat disposed on the opposite side of the substrate to the dye-coat to provide suitable heat resistance and slip and handling properties. Suitable backcoats having a desirable balance of properties include those described in EP-A-314348 and especially those described in EP-A-458522. Particularly preferred backcoats include those in which the backcoat comprises the reaction product of radically co-polymerising in a layer of coating composition, the following constituents:

a) at least one organic compound having a plurality of radically polymerisable saturated groups per molecule and b) at least one organic compound having a single radically polymerisable unsaturated group the backcoat also containing an effective amount, as slip agent, of c) a metallic salt of a phosphate ester.

In cases, where the dye sheet is to be used in a light-induced thermal transfer printing process, a light absorbing material may be included in the dye-coat or, if desired, a separate absorber layer disposed between the dye-coat and the substrate may be employed. The light-absorbing material suitably comprises a material which is an absorber for the inducing light to convert it into the required thermal energy.

If present, the absorber is preferably carbon black, as this provides good absorption and conversion to heat, of a broad spectrum of wavelengths, and hence is not critical to the inducing light source employed for the printing, further, it is also relatively cheap.

However, any suitable absorber materials known in the art may be employed as desired. For lasers operating in the near infrared, there are also a number of organic materials known to absorb at the laser wavelengths. Examples of such materials include the substituted phthalocyanines described in EP-B-157,568, which can readily be selected to match laser diode radiation at 750–900 nm, for example.

A variety of materials can be used for the substrate, including transparent polymer films of polyesters, polyamides, polyimides, polycarbonates, polysulphones, polypropylene and cellophane, for example. Biaxially orientated polyester film is the most preferred, in view of its mechanical strength, dimensional stability and heat resistance,. The thickness of the substrate is suitably 1–50 μm, and preferably 2–30 μm.

Various coating methods may be employed to coat the dye-coat and if present, other coats for example a backcoat, onto the substrate, including, for example, roll coating, gravure coating, screen coating and fountain coating. After removal of any solvent, the coating can be cured by heating or by irradiating with electromagnetic radiation, such as ultraviolet light, electron beams and gamma rays, as appropriate. Typical curing conditions are heating at 50°–150° C. for 0.5–10 minutes (in the case of thermal curing), or exposure to radiation for 1–60 s from an ultraviolet lamp of 80 W/cm power output, positioned about 15 cm from the coating surface (in case of ultraviolet light curing). In-line UV curing may utilise a higher powered lamp, eg up to 120 W/cm power output, focused on the coating as it passes the lamp in about 0.1–10 ms. The coating is preferably applied with a thickness such that after drying and curing the thickness is 0.1–5 μm, preferably 0.2–3 μm, and will depend on the concentration of the coating composition.

The dye sheet may be elongated in the form of a ribbon and housed in a cassette for convenience, enabling it to be wound on to expose fresh areas of the dyecoat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels are suitably in the form of transverse panels, each the size of the desired print, and arranged in a repeated sequence of the colours employed. During printing, panels of each colour in turn are held against a dye-receptive surface of the receiver sheet, as the two sheets are imagewise selectively irradiated to transfer the dye selectively where required, the first colour being overprinted by each subsequent colour in turn to make up the full colour image.

The invention is illustrated by the following non-limiting examples.

EXAMPLE 1

A selection of dye sheets were produced by coating a dye coat of composition listed in Table 1 onto a 6 μm thick polyethylene terephthalate substrate having a subcoat (onto which the dye coat was coated) on one side and a back coat on the opposite side using gravure coating. For all the dye sheets the substrate, sub coat and back coat were the same. Once coated, the dye coat was dried in an oven for 20 seconds at 110° C. to produce a dye sheet having a dry dye coat thickness of 1 μm. Examples 1B, 1C, 1D, 1E, 1F and 1G illustrate the present invention and Example 1A is comparative Examples according to the prior art.

TABLE 1

| Components (wt %) | *1A | 1B | 1C | 1D | 1E | 1F | 1G |
|---|---|---|---|---|---|---|---|
| Dye M0 | 4.00 | 4.31 | 4.84 | 4.31 | 5.78 | 4.00 | 3.68 |
| Dye M3 | 1.07 | 1.08 | 1.21 | 1.08 | 1.45 | 1.00 | 0.92 |
| Ethyl cellulose | 1.18 | — | — | — | — | — | — |
| Polyvinyl butyral | 4.73 | 5.61 | 5.51 | 4.91 | 4.70 | 4.80 | 5.16 |
| LYNCUR MS2 | — | 1.40 | 2.36 | 2.10 | 2.53 | — | — |
| SMA 17352 | — | — | — | — | — | 1.20 | 1.29 |
| Tetrahydro-furan | 89.02 | 87.6 | 86.08 | 87.6 | 85.54 | 89.0 | 88.95 |

*comparative Example

M0 was CI disperse red 60; M3 was 3-methyl-4-(3-methyl-4-cyanoisothiazol-5-ylazo)-N-ethyl-N-acetoxyethyl aniline; Ethyl cellulose was grade ECT-10 available from Hercules; Polyvinyl butyral was SLEC-BX1 available from Sekisui; LYNCURMS2 was a poly(parahydroxystyrene) available from Maruzen; SMA 17352 was a styrene/maleic anhydride copolymer available from Elf Atochem.

EXAMPLE 2

A receiver sheet was produced by coating onto a polyethylene terephthalate substrate having a backcoat and a subcoat, a dye-receptive layer of the following composition:

| | |
|---|---|
| Vylon 200 | 11.60 |
| Tegomer HSi 2210 ((bis-hydroxyalkyl polydimethyl-siloxane from Goldschmidt) | 0.08 |
| Cymel 303 | 0.16 |
| Di-n-butyl amine blocked toluene sulphonic acid catalyst | 0.05 |
| Tinuvin 234 (UV stabiliser) | 0.12 |
| Toluene/Methyl ethyl ketone 47.5/52.5 solvent mixture | to 100% |

The dye-receptive coat was dried for 3 minutes at 140° C. to provide a dry coat thickness of 4 μm.

The dye sheets produced in Example 1 were each brought into contact with a sample of the receiver sheet and thermal transfer printing was effected by means of a programmable print head supplying heat pulses of 2 to 14 millisecond duration to the backcoat of the dye sheet to provide a gradation in the optical density of the print image. The dye sheet and receiver sheet were separated following printing and the reflection optical densities on the receiver sheet were measured using a Sakura densitometer and are shown in Table 2.

EXAMPLE 3

In order to simulate the conditions under which unwanted low temperature thermal transfer under normal print conditions may occur, samples of the dye sheets produced in Example 1 and the receiver sheet produced in Example 2 were fed, in register, through a 2-roll laminator (OZATEC HRL350 hot roll laminator available from Hoechst) at 0.2 $ms^{-1}$. The rolls of the laminator were maintained at a temperature of 60° C. and the pressure between them was 5 bar. The reflection optical densities on the receiver sheet were measured using a Sakura densitometer and are shown in Table 2, the column headings denoting which dye sheet was used in the test.

TABLE 2

| | Optical Density | | | | | | |
|---|---|---|---|---|---|---|---|
| Print Time (ms) | *1A | 1B | 1C | 1D | 1E | 1F | 1G |
| 4.2 | 0.28 | 0.21 | 0.16 | 0.18 | 0.18 | 0.23 | 0.22 |
| 5.6 | 0.56 | 0.39 | 0.29 | 0.33 | 0.32 | 0.46 | 0.42 |
| 7.0 | 0.88 | 0.66 | 0.54 | 0.62 | 0.60 | 0.74 | 0.68 |
| 8.3 | 1.36 | 0.97 | 0.83 | 0.97 | 0.94 | 1.11 | 0.99 |
| 9.7 | 1.96 | 1.49 | 1.29 | 1.54 | 1.51 | 1.69 | 1.47 |
| 11.2 | 2.50 | 2.05 | 1.89 | 2.18 | 2.20 | 2.24 | 1.97 |
| 12.6 | 2.86 | 2.56 | 2.47 | 2.99 | 2.97 | 2.75 | 2.40 |
| 14.0 | 3.13 | 2.92 | 2.98 | 3.44 | 3.48 | 3.14 | 2.69 |
| Low Temperature Thermal Transfer (at 60° C.) | 0.34 | 0.20 | 0.17 | 0.18 | 0.20 | 0.26 | 0.23 |

*comparative Example

The above results illustrate that significant reductions in dye transferred as a result of low temperature thermal transfer may be secured, by using dye sheets according to the present invention whilst maintaining acceptable optical densities in normal printing as compared with dye sheets of the prior art.

We claim:

1. A thermal transfer printing dye-sheet which comprises a substrate having on one side, a dye coat comprising a binder and a thermally transferable dye wherein the binder comprises a mixture of a polyvinyl butyral polymer and a second polymer, at least 10% of the monomeric units of the second polymer being derived from parahydroxystyrene, the phenyl group of which may or may not be further substituted.

2. A dye-sheet according to claim 1, wherein the second polymer is a homopolymer.

3. A dye-sheet according to claim 1, wherein the further substituent is a halogen, hydroxymethyl, dimethylaminomethyl, 2-hydroxyethylmethylaminomethyl or t-butyl.

4. A dye-sheet according to claim 3, wherein the halogen is bromine.

5. A dye-sheet according to claim 1, wherein the second polymer is selected from poly(parahydroxystyrene), poly(bromo-parahydroxystyrene); and copolymers of parahydroxystyrene and any one of styrene, methyl (meth) acrylate, hydroxyethyl(meth)acrylate and butyl(meth)acrylate.

6. A dye-sheet according to claim 1 wherein the polyvinyl butyral polymer has a molecular weight of 30,000 to 250,000.

7. A dye-sheet according to claim 1 wherein the substrate has a backcoat on the opposite side to the dye-coat.

8. A dye-sheet according to claim 1 for use in a light-induced thermal transfer process wherein a light absorbing material is present in the dye coat and/or a separate layer interposed between the dye coat and the substrate.

9. A thermal transfer printing dye-sheet which comprises a substrate having on one side, a dye coat comprising a binder and a thermally transferable dye wherein the binder comprises a mixture of a polyvinyl butyral polymer and a second polymer selected from the group consisting of a parahydroxystyrene homopolymer, a bromo-parahydroxystyrene homopolymer, a copolymer of parahydroxystyrene and parahydroxystyrene further substituted with hydroxymethyl, dimethylaminomethyl, 2-hydroxyethylmethylaminomethyl or t-butyl, or a copolymer of parahydroxystyrene with or without a further substituent and any one of styrene, methyl(meth)acrylate, butyl (meth)acrylate and acrylic acid.

* * * * *